US005901542A

United States Patent [19]

Dinkelmann et al.

[11] Patent Number: 5,901,542

[45] Date of Patent: May 11, 1999

[54] RING-SPINNING MACHINE WITH SPRING-BIASED THREAD-GUIDE EYE

[75] Inventors: Friedrich Dinkelmann, Rechberghausen; Andreas Olbrich, Kirchheim/Tech, both of Germany

[73] Assignee: Zinser Textilmaschinen GmbH, Ebersbach/Fils, Germany

[21] Appl. No.: 09/041,092

[22] Filed: Mar. 12, 1998

[30] Foreign Application Priority Data

Mar. 12, 1997 [DE] Germany ..... 197 10 243

[51] Int. Cl.[6] ..... D01H 7/52

[52] U.S. Cl. ..... 57/75; 57/352; 57/354

[58] Field of Search ..... 57/75, 352, 354, 57/356, 127.6

[56] References Cited

U.S. PATENT DOCUMENTS

| | | | |
|---|---|---|---|
| 2,729,050 | 1/1956 | Honig | 57/352 |
| 3,269,104 | 8/1966 | Morita | 57/106 |
| 3,701,247 | 10/1972 | Rehn et al. | 57/75 |

FOREIGN PATENT DOCUMENTS

| | | | |
|---|---|---|---|
| 0 046 810 | 3/1985 | European Pat. Off. . | |
| 2 154 446 | 5/1972 | Germany . | |
| 1 685 673 | 10/1972 | Germany . | |
| 60-146022 | 1/1985 | Japan . | |
| 60-155739 | 8/1985 | Japan . | |
| 383221 | 11/1932 | United Kingdom | 57/75 |
| 948 537 | 2/1964 | United Kingdom . | |

*Primary Examiner*—William Stryjewski
*Attorney, Agent, or Firm*—Herbert Dubno

[57] ABSTRACT

A ring-spinning machine has spindles with head pieces, e.g. with fingers about which the yarn can be wound to reduce the ballooning of the yarn around the respective spindles. The thread-guide eyes above the headpieces can be depressed against a spring force from normal positions to enable the yarn to wind around the fingers and the spring force restores the eyes to their normal positions, thereby avoiding changes in the distances between the normal positions and the headpieces which may alter the spinning properties and yarn quality.

14 Claims, 4 Drawing Sheets

RING-SPINNING MACHINE WITH SPRING-BIASED THREAD-GUIDE EYE

FIELD OF THE INVENTION

Our present invention relates to a ring-spinning machine having spindles and thread-guide eyes through which the yarn is delivered to the traveler on the ring surrounding the spindle and then onto a core sleeve fitted on the spindle in the formation of a bobbin.

BACKGROUND OF THE INVENTION

A ring-spinning machine generally comprises, on each side of the machine frame, a row of spindles each of which can be considered to represent a station at which yarn, usually fed from a drafting frame, is twisted and wound upon a core sleeve on the spindle. In the process, a yarn balloon is formed around the spindle. The apparatus can then include a ring surrounding the spindle and usually on a ring rail which can move relative to the spindle or with respect to which the spindle can move relatively in an axial direction so that the yarn of the bobbin is distributed over the length of the core sleeve. At the lower end of the balloon, therefore, the yarn can pass through a traveler riding on this ring. The balloon is formed as a result of centrifugal forces on the yarn and the yarn tension, which is in part determined by the centrifugal forces, can contribute to thread breakage.

To limit the expansion of the balloon, a balloon confining or constricting ring may be provided around the spindle as well and in the ring spinning of a yarn, measures to limit the balloon can contribute to a reduction in the rate of thread breakage and thus to an improvement in yarn quality.

Earlier systems tended to use traveling thread-guide eyes or, as described in DE-OS 21 54 446, for example, thread guides which are fixedly mounted on the ring-spinning machine or even thread guides which can be upwardly swingable (DE-OS 16 85 673). In the latter construction, the pivot axis of the thread guide is fixed with respect to the ring-spinning machine while the thread-guide eye itself can be upwardly swingable in combination with the balloon-constricting ring. Other swingably-mounted thread guides are described in Japanese open applications SHO-60-155739 and SHO-60-146022.

In the British patent 948,537 an articulated mounting of the thread guide on a bar is described, the mounting allowing the upward swing of the thread guide for a bobbin-change operation.

A thread-guide eye can be embedded in a piezoelectric elastic element (EP 0 046 810 B1) enabling the detection of yarn breaks as a result of characteristic oscillations generated by the passage of the yarn through the guide. In U.S. Pat. No. 3,269,104, a spring-mounted thread-guide eye is described which allows the holder to be shiftable in a longitudinal slot or hole.

All of these systems have been proposed for spindles onto which the yarn is deposited only after passing through the traveler.

It has been found, however, that for effective limitation of the development of a yarn balloon, it can be advantageous to provide a headpiece for the spindle, i.e. to mount on the spindle, an element which engages in one or more turns the yarn so that the yarn balloon is formed between the headpiece and the traveler before the yarn is deposited on the core sleeve. Such a headpiece, which is fitted onto the top of the spindle, has a configuration, e.g. that of a finger, which allows the yarn to wind thereon in one or more loops.

The service person for such a machine can press the thread guide down sufficiently that the yarn will wind around the headpiece on the spindle. Because of the more or less considerable force which can develop, a forcible connection between the thread guide and any mounting element can become dislocated.

After a certain period of operation and multiple depressions of the thread guide, significant variation can occur between the positions of the thread-guide eyes and respective spindle headpieces for the machine to vary the tension state in the respective spinning triangles, yarn balloons and the winding zones for the various stations. As a consequence, there is a significant quality variation in the spun yarn from bobbin to bobbin and station to station along the machine. For the purposes of this description, the spinning triangle will be understood to be the region between the last pair of rolls of the drafting frame, the thread-guide eye and the headpiece of the spindle. It is in this region that the spinning of the yarn is most pronounced. The balloon zone will be understood to be that region between the headpiece of the spindle and the traveler or ring, and the winding zone, that region between the traveler or the ring and the point at which the yarn is deposited upon the core sleeve.

OBJECTS OF THE INVENTION

It is, therefore, the principal object of the present invention to provide an improved ring-spinning machine whereby, in spite of the intervention of service personnel upon the thread-guide eye, e.g. by depressing the thread-guide eye of each station against the headpiece of the spindle thereof any number of times, uniform yarn quality is obtained from bobbin to bobbin.

Another object of this invention is to provide an improved ring-spinning machine which overcomes drawbacks with earlier ring-spinning machines, especially where those machines are equipped with spindle headpieces to reduce the ballooning of the yarn.

SUMMARY OF THE INVENTION

These objects and others which will become apparent hereinafter are attained, in accordance with the invention, by providing a system which has a thread-guide eye in combination with a balloon-reducing spindle headpiece and wherein each thread-guide eye is mounted so that it can be depressed in the direction of the spindle tip against a spring force, i.e. resiliently.

More particularly, a ring-spinning machine according to the invention can comprise:

- a respective upright spindle at each of a multiplicity of ring spinning stations;
- a ring surrounding the spindle and forming a guide for a traveler;
- a headpiece on the spindle for limiting development of a yarn balloon between the headpiece and the traveler as the yarn is deposited on a core sleeve on the spindle;
- a thread-guide eye above the headpiece and guiding the yarn onto the headpiece;
- a support on the machine carrying the thread-guide eye;
- a holder for the thread-guide eye swingably mounted on the support between a normal position of the thread-guide eye aligned with the headpiece and an upwardly swung position of the thread-guide eye, the thread-guide eye being deflectable toward the headpiece; and
- spring means acting upon the thread-guide eye for biasing the thread-guide eye into the normal position upon deflection of the thread-guide eye from the normal position toward the headpiece.

Since each thread-guide eye relative to its fixed mounting member or support, is resiliently deflectable so that it is biased by a spring force back into its normal position whenever it is pressed out of the normal position toward the spindle tip, an undesired shift in the forcible coupling between the thread guide and this holder or mounting element is excluded. Different thread tension relationships from spinning location to spinning location can thereby be avoided without incurring any significant cost. Indeed, the force required for depressing the thread guide toward the headpiece of the spindle can be reduced with use of a spring element. Service of the ring-spinning machine can therefore be simplified.

The spring means can be a separate spring element in the form of a bent spring, for example, a leaf spring, a coil spring (preferably of a cylindrical or conical configuration), or as an elastic cushion, for example an elastomer. The spring element can, if desired, fix the normal position of the thread-guide eye.

Alternatively, the holder or mounting member for the thread-guide eye itself can be elastic or in a mounting portion of the thread-guide eye, a bendable metallic or film hinge can be formed. The film hinge can be produced together with a holder or a part thereof by a two-component injection-molding operation.

In a particular configuration of the system of the invention, the normal position of the holder for the thread-guide eye can be established by two adjacent coil torsion springs which encircle the bearing pins. The spring displacement can be limited by an abutment.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
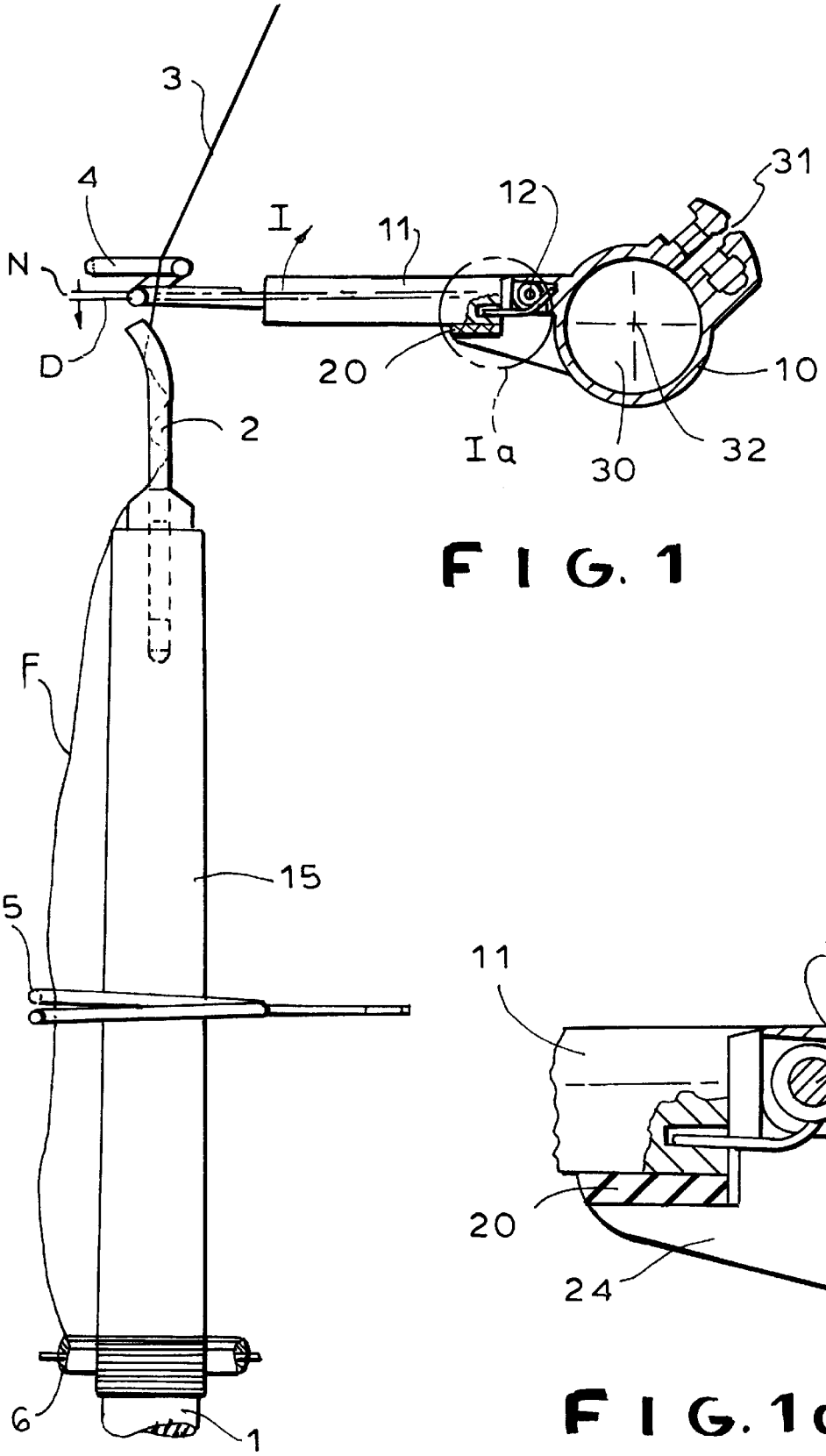
FIG. 1 is a side view, partly in section and partly broken away of a spindle provided with a spindle cap having a finger, in accordance with the invention, and a thread-guide eye.

FIG. 1 shows in schematic side view a spindle 1 on which a core sleeve 15 can be fitted and which is provided at its upper end with a balloon reducing headpiece 2 in the form of an upwardly-extending finger. Above the headpiece 2 there is provided a thread-guide eye 4. The sleeve 15 is surrounded by a balloon constriction ring 5. A yarn 3 is supplied by a drafting frame not shown and passes through the thread-guide eye 4 onto the finger 2 which is encircled with at least one turn. The yarn 3 passes from the finger 2 to a balloon F which is confined by the balloon-constricting ring 5 and then around a traveler on the ring 6 and then onto the sleeve 15.

The thread-guide eye 4 is affixed to a holder 11 which is swingably mounted by a bearing pin 12 about an axis perpendicular to the plane of the paper and generally parallel to the row of spindles of the ring-spinning machine. A support in the form of a bar 30 affixed to the machine frame and extending parallel to the row of spindles horizontally has a bracket 10 which mounts the pivot pin 12 on the bar 30. A clamping screw arrangement represented at 31 can lock the bracket 10 on the bar or tube 30. The holder 11 can be biased upwardly as represented by the arrow I about the pin 12 and/or the bar 30 can be rotated about the axis 32 by appropriate means so that the thread-guide eye 4 can be swung in the direction of this arrow out of the normal position N. The drive means for so pivoting the thread-guide eyes as to swing them upwardly has not been shown.

Figure 1A:
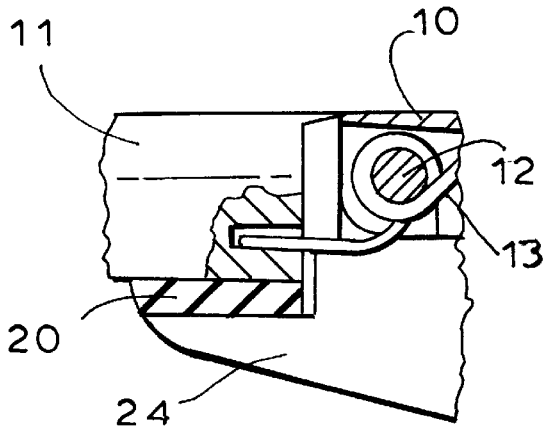
FIG. 1*a* is a view of the region Ia of FIG. 1 drawn to a larger scale.

From FIGS. 1 and 1*a*, it will be apparent that a spiral spring 13, i.e. a torsion spring, can surround the pin 12 and can be so arranged that it will bias the holder 11 from its upwardly swung position back into the normal position N.

It has also been noted previously that it is important that a spring means be provided to resist the downward deflection of the yarn-guide eye 4. This can be, for example, a separate spring element, e.g. an elastic cushion 20 which, if desired, can be a stack of Belleville washers or the like. This cushion 20 can, however, simply be a block of an elastomer.

Because of the elastic cushion, a service person can depress the yarn-guide eye 4 from its normal position N to its depressed position D by a small but defined angular extent in the counterclockwise sense downwardly and for a sufficient length of time to enable the yarn 3 to loop around the headpiece 2. In spite of this downward depression, the connection 31 between the holder 11 and the machine frame, e.g. the bar 30, will not be altered, nor will the bracket 10 be shifted relative to the frame in an undesirable manner. The downward pivoting of the holder 11 is limited by a lower abutment 24 of the bracket 10 as can be seen from FIG. 1*a*.

Figure 2:
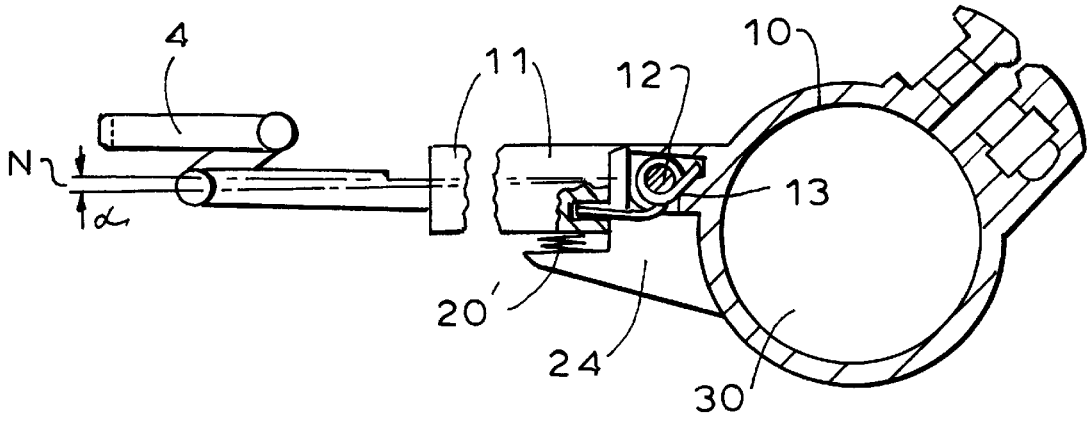
FIGS. 2 and 3 are sectional views through the support of two other thread guides showing different types of spring elements, in accordance with the invention shown in side elevation, but partly broken away.

From FIG. 2 it will be apparent that instead of an elastic cushion, the spring means can be a compression-type coil spring as has been represented at 20' and which is supported on the abutment 24 in engagement with the underside of the holder 11. Because of the presence of this coil spring 20', the thread-guide eye 4 can be deflected downwardly from the normal position through an angle $\alpha$ without shifting the bracket 10 or the support bar 30. When the thread-guide eye 4 is released, of course, the spring 20' restores it to its normal position N.

Figure 3:
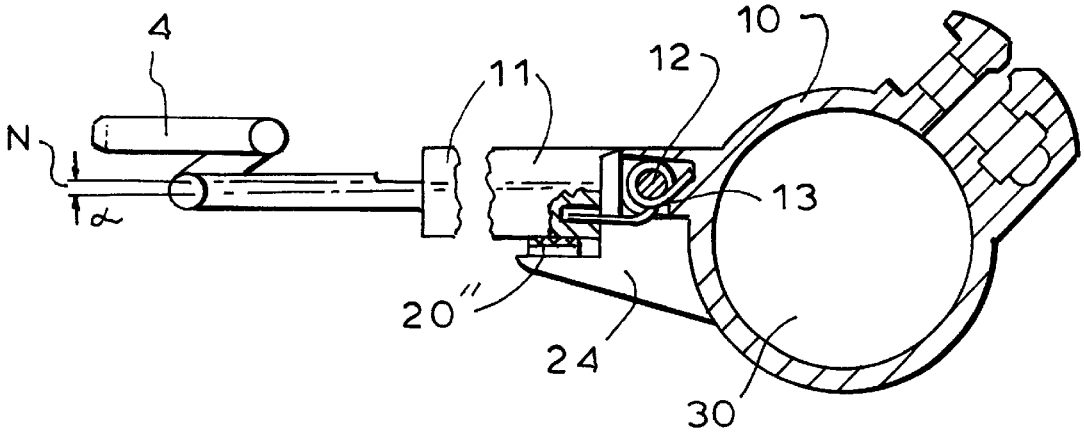
Figure 4:
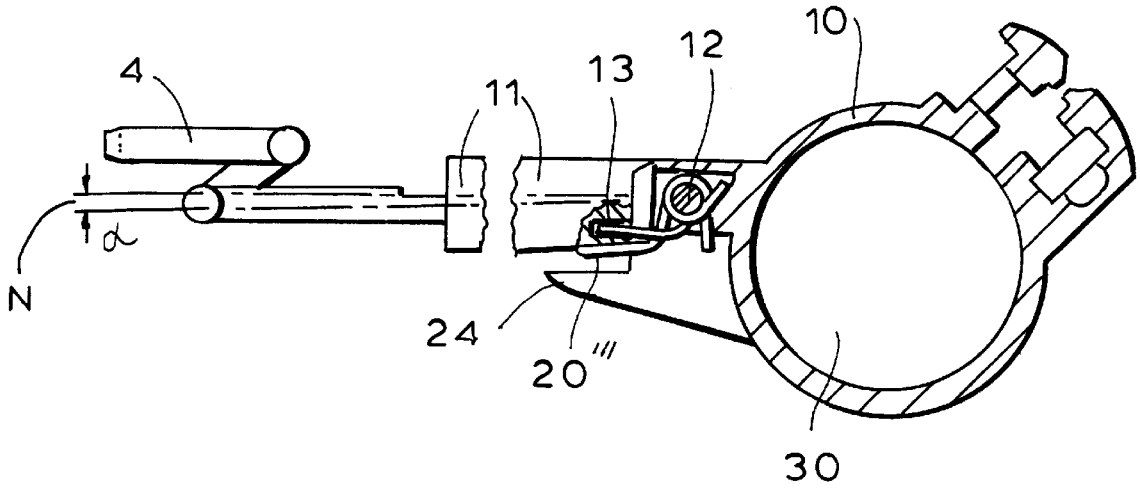
FIG. 4 is a view similar to FIGS. 2 and 3 illustrating an embodiment of the thread guide with two coil torsion springs.

FIG. 3 shows an embodiment wherein a bent leaf spring 20", which can have the shape of an arch, is provided on the abutment 24 to engage the underside of the holder 11. When the eye 4 is depressed against this leaf spring in the counterclockwise sense, it has a maximum excursion $\alpha$ as has been described and is restored to the normal position N by the force of the spring 29". A further variant has been shown in FIG. 4. Here, in addition to the coil spring 13 previously described, for returning the holder 11 from its upwardly swung position into the normal position, a second torsion spring 20'" is provided around the pin 12 and supports the holder 11 from below against depression of the holder through the angle $\alpha$, the spring force of the additional spring

20''' being sufficient to return the thread-guide eye 4 to its normal position after it has been depressed.

In the normal position N, the thread guide 4 is located in a force equilibrium between two torsion springs 13 and 20'''.

Figure 5A:
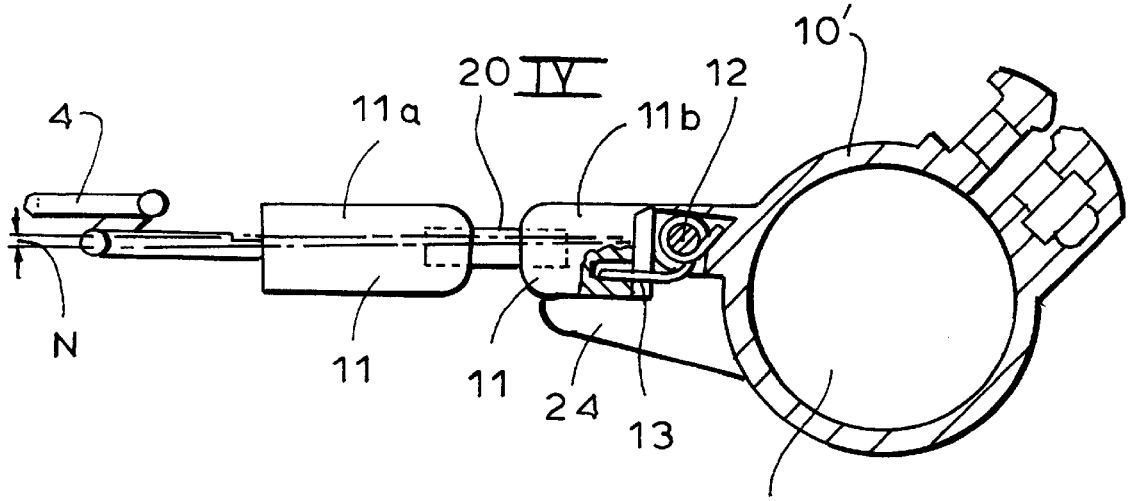
FIG. 5*a* is another view similar to FIGS. 2 and 3 of an embodiment in which the holder has a bendable metallic portion providing the spring means of this invention.
Figure 5B:
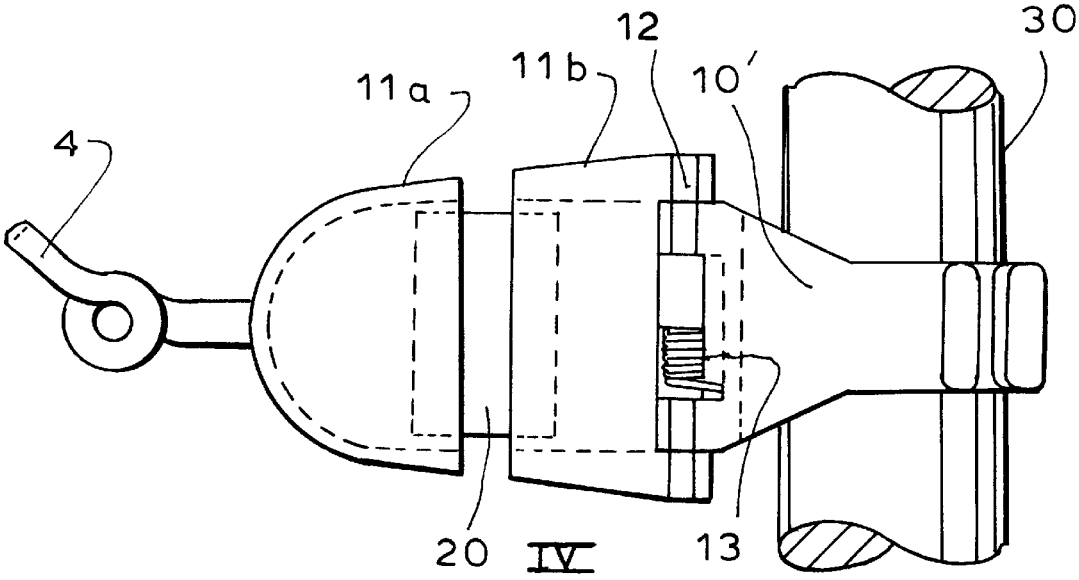
FIG. 5*b* is a plan view thereof.

As will be apparent from FIGS. 5*a* and 5*b*, the spring means can also be a bendable metallic portion $\mathbf{20}^4$ between two parts 11*a* and 11*b* of the holder 11. This bendable metal portion $\mathbf{20}^4$ may also represent a film hinge which can be formed unitarily with the other portions 11*a* and 11*b* of the holder 11 in a two-component injection molding operation. In this case, when the holder part 11*b* is braced against the abutment 24 of the bracket 10' in the normal position N of the thread-guide eye 4, the thread-guide eye can nevertheless be depressed with bending of the portion $\mathbf{20}^4$, the restoring force of this spring means returning the thread-guide eye to its normal position after the pressure is released.

Figure 6:
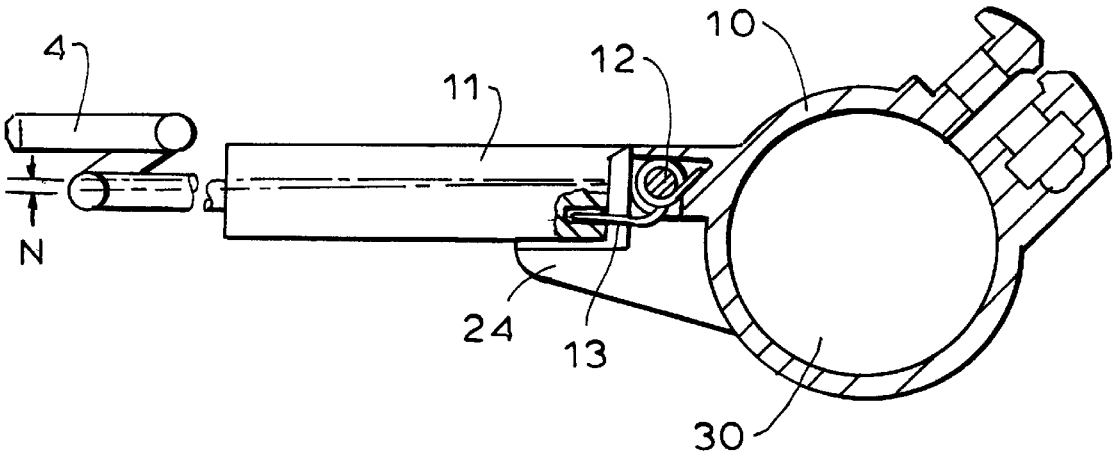
FIG. 6 is a side elevation view of another embodiment and, partly broken away, showing the mounting of the thread-guide eye to a support in cross section.

FIG. 6 shows yet another embodiment of the invention in which the torsion spring 13 also acts as the spring means allowing deflection of the thread-guide eye 4 from its normal position. In this case the abutment 24 is spaced sufficiently below the holder 11 to permit the downward deflection of the thread-guide eye 4.

Because the holder 11 can be resiliently depressed by the service person, it can be held down as long as is necessary to allow the yarn 3 to loop around the finger 2 and then is pressed upwardly upon release by the spring means without causing any alteration of the position of the bracket 10 or the bar 30. The spacing over time and in the operating position between the thread guide and the finger does not alter and uniform formation of the yarn is ensured.

We claim:

1. A ring spinning machine comprising:

a respective upright spindle at each of a multiplicity of ring spinning stations;

a ring surrounding said spindle and forming a guide for a traveler;

a headpiece on said spindle for limiting development of a yarn balloon between said headpiece and said traveler as said yarn is deposited on a core sleeve on said spindle;

a thread-guide eye above said headpiece and guiding said yarn onto said headpiece;

a support on the machine carrying said thread-guide eye;

a holder for said thread-guide eye swingably mounted on said support between a normal position of said thread-guide eye aligned with said headpiece and an upwardly swung position of said thread-guide eye, said thread-guide eye being deflectable toward said headpiece; and spring means acting upon said thread-guide eye for biasing said thread-guide eye into said normal position upon deflection of said thread-guide eye from said normal position toward said headpiece.

2. The ring-spinning machine defined in claim 1 wherein said spring means is a spring element in the form of an elastic cushion, a coil spring, a leaf spring or a stack of Belleville washers.

3. The ring-spinning machine defined in claim 2 wherein said spring means establishes said normal position of said thread-guide eye.

4. The ring-spinning machine defined in claim 1 wherein said spring means is an elastic portion of said holder.

5. The ring-spinning machine defined in claim 4 wherein said elastic portion is a bendable metallic portion.

6. The ring-spinning machine defined in claim 4 wherein said elastic portion is a film hinge.

7. The ring-spinning machine defined in claim 4 wherein said elastic portion is formed in one piece with said holder in a two-component injection molding process.

8. The ring-spinning machine defined in claim 1 wherein said spring means is a torsion spring.

9. The ring-spinning machine defined in claim 1, further comprising an abutment limiting displacement of said holder against said spring means.

10. The ring-spinning machine defined in claim 1, further comprising a pin about which said holder is swingable about said support into said upwardly swung position, and a torsion spring surrounding said pin and bearing upon said holder for restoring said holder to said normal position of said thread-guide eye from said upwardly swung position.

11. The ring-spinning machine defined in claim 10 wherein said spring means includes another torsion spring on said pin adjacent said first-mentioned torsion spring.

12. The ring-spinning machine defined in claim 10 wherein said spring means includes a spring separate from said torsion spring and received between an abutment of a bracket carrying said pin and said holder.

13. The ring-spinning machine defined in claim 10 wherein said spring means is formed by a portion of said torsion spring.

14. The ring-spinning machine defined in claim 10 wherein said spring means is formed by a resilient portion of said holder.

* * * * *